US008061521B1

(12) United States Patent
Lowry et al.

(10) Patent No.: US 8,061,521 B1
(45) Date of Patent: Nov. 22, 2011

(54) PACKAGING SYSTEM FOR A LARGE ARTICLE

(75) Inventors: James Lowry, Franklin, TN (US); Ronald Kroeckel, Hermitage, TN (US)

(73) Assignee: Sonoco Development Inc., Hartsville, SC (US)

( * ) Notice: Subject to any disclaimer, the term of this patent is extended or adjusted under 35 U.S.C. 154(b) by 0 days.

(21) Appl. No.: 13/097,562

(22) Filed: Apr. 29, 2011

Related U.S. Application Data

(60) Provisional application No. 61/330,152, filed on Apr. 30, 2010.

(51) Int. Cl.
*B65D 85/30* (2006.01)

(52) U.S. Cl. ..... 206/576; 206/585; 206/592

(58) Field of Classification Search ..... 206/576, 206/320, 453, 523, 585, 586, 587, 588, 591, 206/592, 594
See application file for complete search history.

(56) References Cited

U.S. PATENT DOCUMENTS 3,650,459 A * 3/1972 Tucker ..... 206/599
4,759,446 A * 7/1988 Dobashi et al. ..... 206/586
4,851,286 A * 7/1989 Maurice ..... 428/316.6
4,897,980 A * 2/1990 Geyser et al. ..... 53/128.1
4,919,270 A * 4/1990 Govang et al. ..... 206/597
5,911,179 A 6/1999 Spiczka
6,059,104 A * 5/2000 Widman ..... 206/320
6,105,511 A 8/2000 Bridges
6,155,419 A 12/2000 Sowa
6,240,854 B1 6/2001 Heil
6,247,596 B1 * 6/2001 Muyskens ..... 206/586
6,539,881 B2 4/2003 Underbrink et al.
6,769,368 B2 8/2004 Underbrink et al.
7,654,390 B2 * 2/2010 Baechle et al. ..... 206/386
2002/0179469 A1 12/2002 Tornga et al.
2004/0108238 A1 6/2004 Maresh
2004/0232021 A1 11/2004 Linton
2008/0000397 A1 1/2008 Dickinson et al.

* cited by examiner

*Primary Examiner* — Jacob K Ackun
(74) *Attorney, Agent, or Firm* — Miller, Matthias & Hull LLP

(57) ABSTRACT

A packaging system for a printer/copier or other large article that uses less material than conventional packaging systems. In one embodiment the system comprises a pair of elongated foam braces that slide over pairs of vertically oriented corner posts for holding and cushioning the packaged article. In another embodiment the system comprises four foam braces wedged between the four vertical edges of the article and vertical corner posts.

7 Claims, 5 Drawing Sheets

PACKAGING SYSTEM FOR A LARGE ARTICLE

BACKGROUND OF THE INVENTION

1. Field of the Invention

This invention patent relates to a packaging system. More particularly, this invention relates to a packaging system for a printer/copier or other large article that uses less material than conventional packaging systems.

2. Description of the Related Art

Many current packaging systems for medium to large format copier/printers are based on the concept that more packaging material equals more protection. With current packaging material costs increasing and the increased need for sustainable packaging, excessive packaging is becoming cost and environmentally prohibitive.

Another disadvantage of many existing packaging systems is that they are heavy and difficult to stack during storage, shipping and handling.

A third disadvantage of conventional packaging for copiers and printers is that it is difficult to remove the product from the packaging.

Thus it is an object of the present invention to provide a packaging system for a copier/printer or other heavy article that uses less packaging material.

Another object of the present invention is to provide a packaging system that is lighter than conventional packages and easier to stack during storage, shipping and handling.

Still another object of the present invention is to provide a packaging system that is makes it easier to remove the product from the packaging.

Further and additional objects will appear from the description, accompanying drawings, and appended claims.

A number of packaging systems are known in the art, of which the following are representative:

U.S. Pat. No. 6,155,419 discloses a package comprising a base, corner posts, a top cap and stretch wrap.

U.S. Pat. No. 6,240,854 discloses a pallet base for wheeled equipment such as a photocopier. The pallet base comprises a series of ramps and built-in removable wedges that can placed on the ramps to form a level track for rolling a copier onto the pallet.

U.S. Pat. No. 6,539,881 discloses a pallet base with an integral ramp.

U.S. Patent Publication No. 2002/0179 18 9 discloses a package for a photocopier.

U.S. Patent Publication No. 2004/0108238 discloses a pallet base with integral fold down ramp members.

BRIEF SUMMARY OF THE INVENTION

The present invention is a packaging system for a printer/copier or other large article that uses less material than conventional packaging systems. Compared to conventional packaging systems, the present system has been found to significantly reduce overall packaging weight and overall packaging volume. The system also reduces foam weight, foam volume, paper weight and paper volume.

In one embodiment the packaging system comprises a base tray, a plurality of foam base inserts, corner posts, a top tray, and two elongated foam braces. The base tray comprises a rectangular bottom panel and upwardly extending side panels affixed to the perimeter of the bottom panel. The foam base inserts are disposed within the base tray, with each foam base insert comprising a horizontal load bearing panel located adjacent the bottom panel of the base tray and a vertical panel extending upwardly from the load bearing panel. Each corner post extends from a corner of the bottom panel to the top tray. The top tray is placed onto the top ends of the corner posts and comprises a top panel having a perimeter and side panels extending downward from the top panel perimeter. Each elongated foam brace extends from one corner post to a second, orthogonally opposing corner post, and defines a vertically oriented opening at either end of the brace through which a corner post extends. Each foam braces is slid over a pair of corner posts during assembly of the packaging system.

An optional accessory tray having a rectangular central panel having four corners and side panels extending vertically upward from the central panel to define a space within the accessory tray for storing accessories may be placed onto the top surfaces of the foam braces. The accessory tray may have a central panel defining openings at each corner through which the corner posts extend. The accessory tray is simultaneously slid over all four corner posts during assembly.

A pair of optional hinged ramps may be disposed within the base tray, with each ramp having a first leg located adjacent the base tray bottom panel and a second leg hingedly connected to the first leg. The ramps may be used to unload the article after being shipped to its final destination.

The invention also includes a method of packaging an article. The method includes the steps of providing a flat base tray comprising a substantially rectangular bottom panel having a perimeter and side panels affixed to the bottom panel perimeter along fold lines; providing a pair of ramps, each ramp comprising a first leg and a second leg hingedly connected to the first leg; placing the ramps within the base tray so that the first leg of each ramp is adjacent the base tray bottom panel and the second leg extends outward beyond the perimeter of the bottom panel; placing the article onto the base tray so that its wheels rest on the first legs of the ramps; placing foam base inserts within the base tray under the article so that the foam base inserts abut the sides of the article; folding up the second legs of the ramps until they abut the sides of the printer; folding up the base tray side panels against the foam base inserts; securing a horizontal band around the base tray side panels, thereby securing the base tray and foam base inserts in position; inserting corner posts into the base tray so a corner post extends vertically upward from each bottom panel corner; sliding two foam braces over the upper ends of respective pairs of adjacent corner posts until the foam braces fit against the top of the packaged article; sliding an accessory tray over the corner posts until the accessory tray rests on the top surfaces of the two foam braces; and positioning a top cap onto the top ends of the corner posts.

In an alternative embodiment of the invention, the packaging system comprises a base tray, a top tray, corner posts and a plurality of lower braces. The base tray comprises a substantially rectangular bottom panel having a perimeter and upwardly extending side panels affixed to the bottom panel perimeter. Each side panel has an inner, product-facing surface. The bottom panel has four corners. The top tray comprises a top panel having a perimeter and side panels extending downward from the top panel perimeter. Each of the four corner posts extends from a corner of the bottom panel to the top panel. Each corner post comprises an inner wall and a substantially coextensive outer wall joined at opposing longitudinal edges or ends.

Each lower brace has a lower end disposed within the base tray and is configured to be interposed between a corner post and a vertical edge or corner of the article. Each lower brace has an inner wall configured to abut the vertical edge (corner) of the article, an outer wall that abuts a corner post inner wall, and two substantially planar, orthogonally oriented, exterior surfaces that abut the inner surfaces of two of the base tray side panels.

The alternative embodiment packaging system may also comprise four upper braces, each interposed between a corner post and a corner of the article near the top of the article and configured so that they mate with the top contours of the packaged article. Each upper brace may comprise an inner wall configured to abut the article and an outer wall that abuts a corner post inner wall. Each upper brace may also comprise substantially planar, orthogonally oriented exterior surfaces or ends. Each upper brace may have a substantially flat top surface upon which an accessory tray rests. The accessory tray may have a central panel having four corners and side panels extending vertically upward from the central panel to define a space within the accessory tray for storing accessories. The four corners of the accessory tray central panel may be beveled to define spaces exterior to the accessory tray for accommodating the corner posts. The accessories may include a pair of substantially wedge-shaped ramps for use in unloading the packaged article.

DETAILED DESCRIPTION OF THE INVENTION

Figure 1:
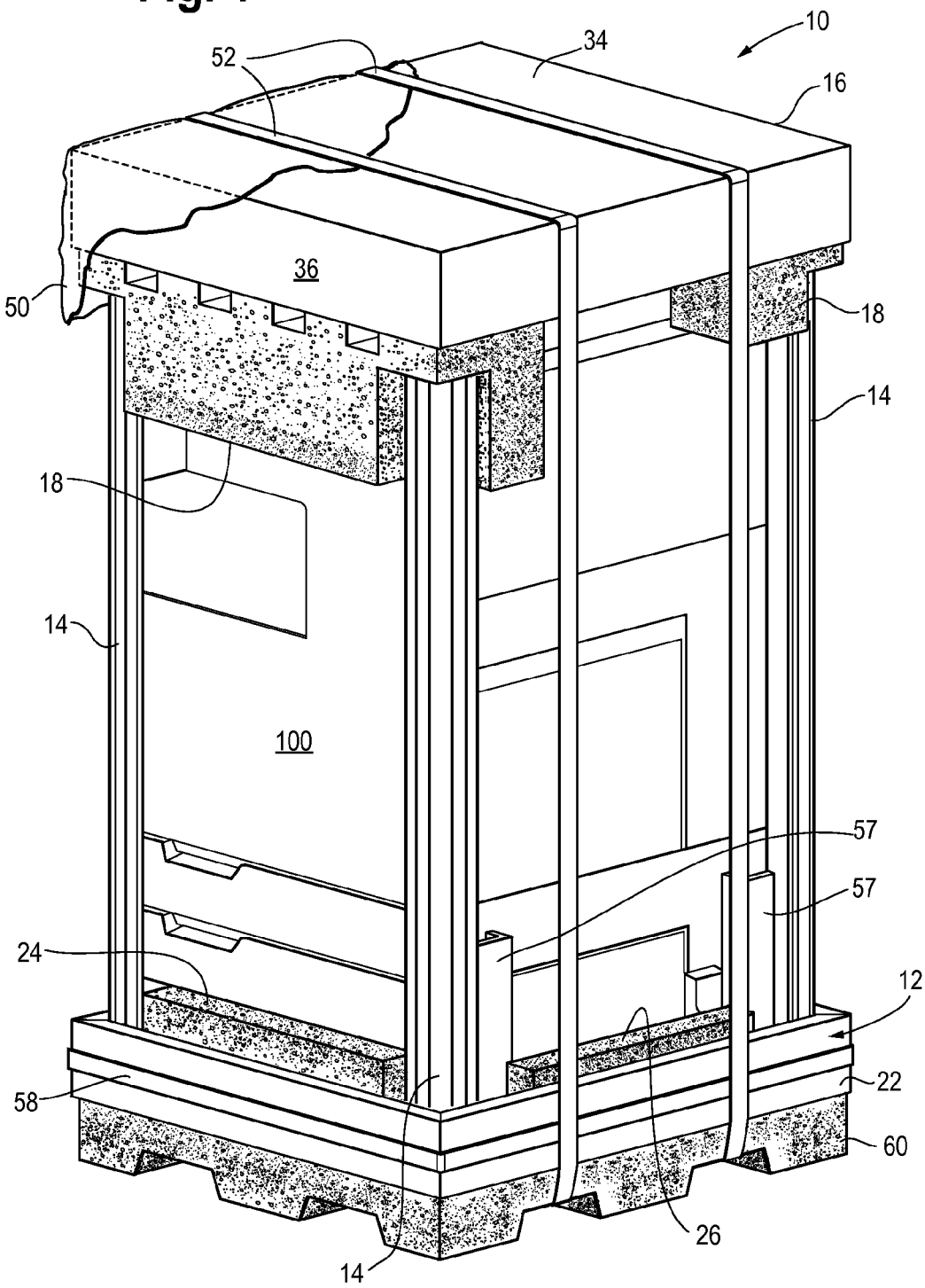
FIG. 1 is a perspective view of a packaging system according to the present invention.

While this invention may be embodied in many forms, there is shown in the drawings and will herein be described in detail one or more embodiments with the understanding that this disclosure is to be considered an exemplification of the principles of the invention and is not intended to limit the invention to the illustrated embodiments.

Figure 2:
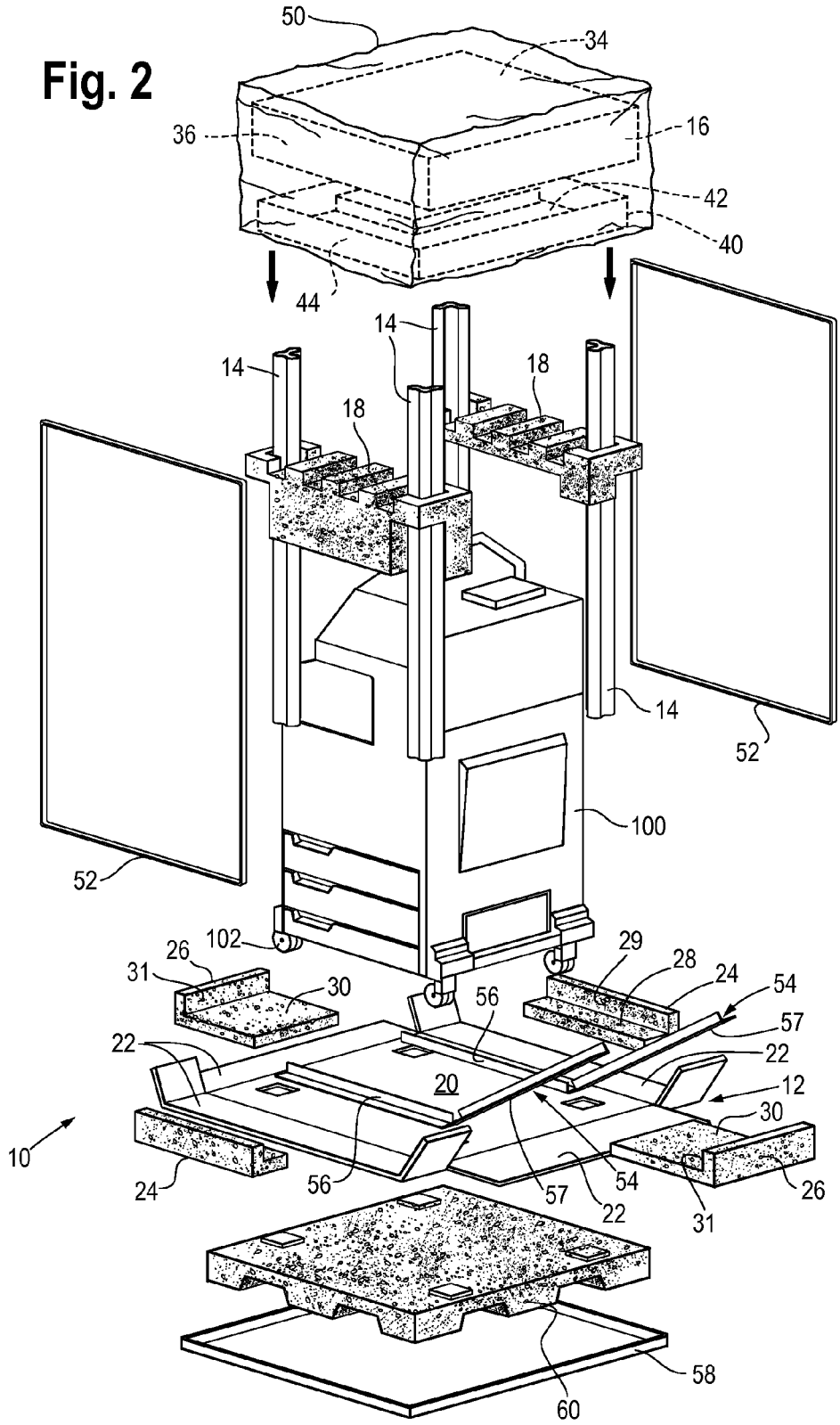
FIG. 2 is an exploded view of the packaging system of FIG. 1.
Figure 3:
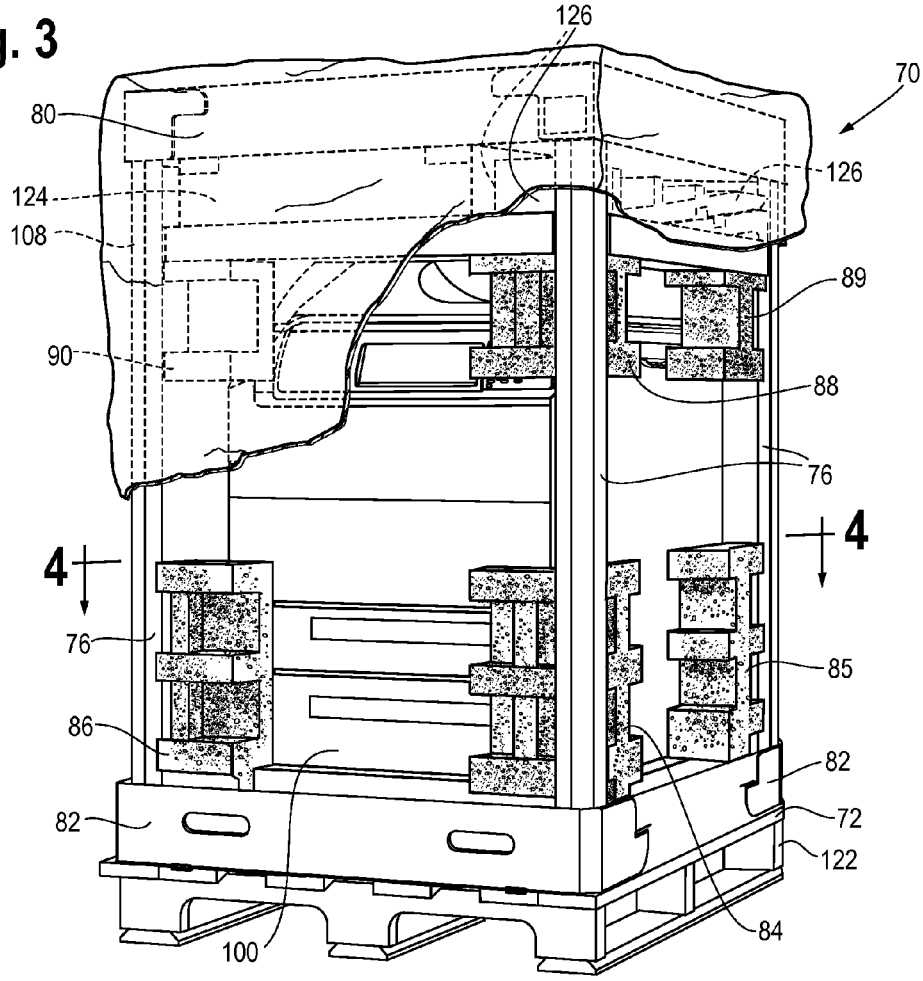
FIG. 3 is a perspective view of a second embodiment of a packaging system according to the present invention.

Turning to the drawings, there is shown in FIGS. 1 and 2 one embodiment of the present invention, a packaging system 10 for an article such as a printer. The packaging system 10 is intended to securely package a copier/printer or other heavy article 100 while using less packaging material than conventional packaging systems. The packaging system 10 is also lighter than conventional packaging systems and easier to stack during storage, shipping and handling. The packaging system 10 is designed to be easier to disassemble than conventional packaging systems.

The system 10 basically comprises a foldable base tray 12, corner posts 14, a top cap 16 and foam braces 18. The base tray 12, corner posts 14 and top cap 16 may be made primarily of paper. The foam braces 18 may be made from expanded polystyrene foam or other suitable material.

The base tray 12 may be formed from a die cut, folded blank and comprises a substantially rectangular bottom panel 20 having a perimeter and upwardly extending side panels 22 hingedly affixed to the bottom panel 20 along its perimeter. The bottom panel 20 defines four corners on which the corner posts 14 rest.

Four foam base inserts 24, 26 are disposed within the base tray 12 to support the packaged article 100. The foam base inserts 24, 26 comprise a first pair of foam base inserts 24 that support each side of the packaged article 100 and a second pair of foam base inserts 26 that support the front and rear of the packaged article 100. Each of the first pair of foam base inserts 24 has a substantially L-shaped cross-section and comprises a horizontal, load bearing panel 28 which is positioned adjacent the base tray bottom panel 20, and a vertical panel 29 extending upwardly from the load bearing panel 28. Likewise, each of the second pair of foam base inserts 26 has a substantially L-shaped cross-section and comprises a horizontal, load bearing panel 30 which is positioned adjacent the base tray bottom panel 20, and a vertical panel 31 extending upwardly from the load bearing panel 30. The four foam inserts 24, 26 are positioned under the along each of the four sides of the base tray 12 with the vertical panel 29, 31 of each foam base insert 24, 26 adjacent a side panel 16 of the base tray 12.

In the assembled packaging system 10 the bottom of the packaged article 100 rests on the load bearing panels 28, 30 of the foam base inserts 24, 26 and the sides, front and rear of the packaged article 100 fit snugly against the vertical panels 29, 31 of the foam base inserts 24, 26.

The top cap 16 is conventional in design and comprises a top panel 34 having a perimeter and side panels 36 extending downward from the top panel perimeter.

An accessory tray 40 used to hold accessories may be disposed over the article 100 between the base tray 12 and top cap 16. The accessory tray 40 has a rectangular central panel 42 having four corners and side panels 44 extending vertically upward from the central panel 42 to define a space within the accessory tray 40 for storing the accessories. The central panel 42 defines openings at each corner for accommodating the four corner posts 14.

The four corner posts 14 extend vertically from the bottom panel 20 to the top panel 34. Each corner post 14 extends through one of the openings in the accessory tray 40. The corner posts 14 protect the article 100 from outside abuse while keeping load off the article 100 during stacking.

A set of two elongated, foam braces 18 are used to further secure the printer 100 inside the packaging system 10. Each foam brace 18 has opposing ends and extends from one corner post 14 to a second, orthogonally opposing corner post 14. Each foam brace 18 defines vertically oriented openings at each end to accommodate a corner post 14. The foam braces 18 can be molded or cut so that they define additional channels for receiving optional horizontal cross supports (not shown). The cross supports provide additional lateral protection.

The foam braces 18 are shaped so that they mate with the top contours of the packaged article 100, thereby holding the article 100 stationary during storage, handling and transport. In other words, the top of the packaged article 100 is wedged between the two foam braces 18. The foam braces may have flat top surfaces on which the accessory tray 40 can rest.

Both the vertical corner posts 14 and the optional cross supports can be convolutely wound hollow paper tubes formed into a desired shape, such as those marketed by Sonoco Products Company of Hartsville, S.C. and described in U.S. Pat. Nos. 4,482,054; 5,593,039; 6,059,104 and 6,186,329, incorporated herein by reference.

A transparent outer wrap 50 may be placed over or stretched tightly around the assembled unit. Bands or straps 52 may be used to secure the transparent outer wrap 50 against the assembled unit. The assembled unit has open ("Clear-view") sides that allow viewing of the packaged article 100.

The packaging system 10 may further comprise two hinged, fold down ramps 54 to aid in the unloading of the article 100. Each ramp 54 comprises a first leg 56 located adjacent the base tray bottom panel 20 and a second leg 57 hingedly connected to the first leg 56. The ramps 54 may be made of wood or any suitable material.

The packaging system 10 may be assembled in the following manner: First, the ramps 54 are placed within the flat (not folded) base tray 12 so that the first leg 56 of each ramp 54 is flush against the base tray bottom panel 20 and the second leg 57 extends outward beyond the perimeter of the bottom panel 20. Next the printer 100 or other article to be packaged is placed onto the base tray 12 so that its wheels 102 rest on the first legs 56 of the ramps 54. Then the foam base inserts 24, 26 are placed within the base tray 12 and under the article 100 so that their vertical panels 29, 31 abut the sides of the article 100 near its base.

Next, the second legs 57 of the ramps 54 are folded up against the sides of the printer 100. Then the base tray side panels 16 are folded upward against the foam base inserts 24, 26 and a horizontal band or strap 58 is positioned securely around the side panels 16 to secure the side panels 16 against the foam base inserts 20.

The corner posts 14 are then inserted into the base tray 12 at each corner so that each support post 14 is vertically oriented. The foam braces 18 are then slid over the upper ends of respective pairs of adjacent corner posts 14 until they fit against the top of the packaged article 100. The accessory tray 40 (which may contain accessories) is slid over the vertical support posts 50 until it rests on the top surfaces of the foam braces 18. Optional cross braces may be wedged inside the accessory tray 40. The top cap 16 is positioned onto the top ends of the corner posts 14.

The assembled unit can then be wrapped in transparent outer wrap 50 so that the wrapping extends from the top cap 16 to the base tray 12 and is stretched tightly around the vertical support posts 14. Alternatively, a bag-like transparent outer wrap 50 be placed over the unit as shown in FIG. 2.

The unit may be placed onto a pallet 60 and retainer straps 52 used to hold the unit 10 to the pallet 60. The pallet 60 can be formed of folded corrugated, wood, plastic or any suitable material.

Thus there has been described a packaging system for a printer/copier or similar article. Compared to conventional packages, the packaging system has been found to significantly reduce overall packaging weight and overall packaging volume. The system also reduces foam weight, foam volume, paper weight and paper volume. The packaging system can be made of 100% recyclable paper content. The system results in a higher shipping and storage density, resulting in substantial warehouse and freight savings.

Second Embodiment

A second embodiment of the invention is shown in FIGS. 3-8. The packaging system 70 according to this second embodiment basically comprises a base tray 72, a foam base insert 74, corner posts 76, a top cap 80 and lower and upper foam braces. The base tray 72, corner posts 76 and top cap 80 may be made primarily of paper. The foam braces may be made from expanded polystyrene foam or other suitable cushioning material.

As in the first embodiment, the base tray 72 may be formed from a die cut, folded blank and comprises a substantially rectangular bottom panel 81 having a perimeter and upwardly extending side panels 82 hingedly affixed to the bottom panel 81 along its perimeter. The base tray 72 defines four corners for accommodating the corner posts 76.

The four corner posts 76 extend vertically from the bottom panel 81 to the top panel 104 of the top cap 80. As perhaps best shown in FIG. 4, each corner post 76 comprises an inner, article facing, wall 77 and a substantially coextensive outer wall 78 joined at opposing longitudinal edges or ends 79 to form a hollow tube.

Figure 4:
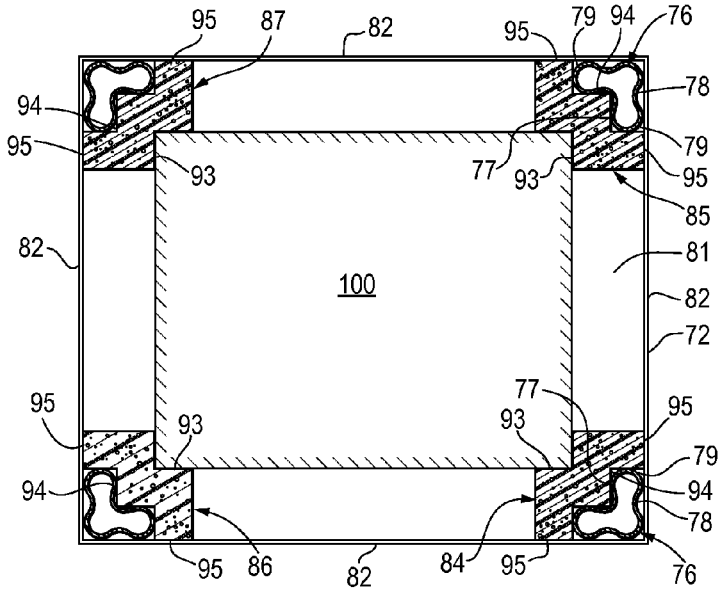
FIG. 4 is a cross-sectional view of the packaging system of FIG. 3 taken along line 4-4.
Figure 5:
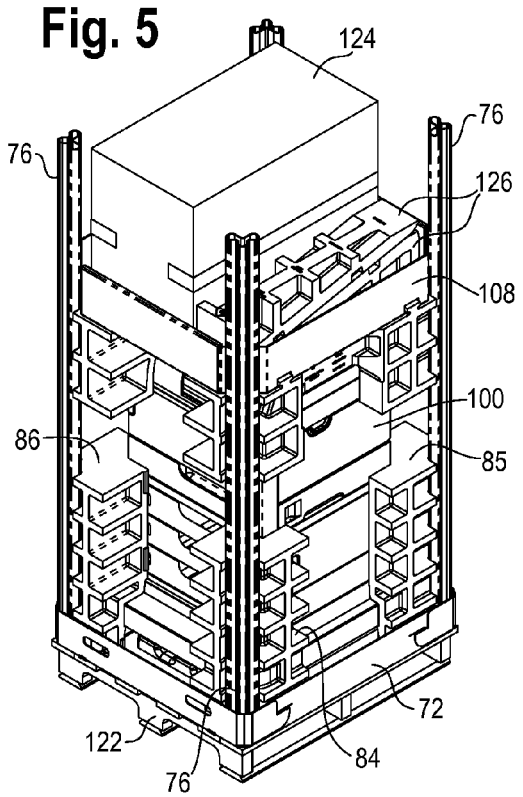
FIG. 5 is a perspective view of the packaging system of FIG. 3 shown partially assembled.

Each of four lower braces 84, 85, 86, 87 has a lower end disposed within the base tray 72. Each lower brace 84, 85, 86, 87 is wedged between a corner post 76 and a vertical edge (corner) of the article 100 near the article's bottom end to help hold the article 100 in place and protect the article 100 from outside abuse. As best shown in FIG. 4, each of the four lower braces 84, 85, 86, 87 is configured to abut a vertical edge of the article 100, and includes an inner wall 93 that abuts the article 100 and an outer wall 94 that abuts a corner post inner wall 77. Each of the four lower braces 84, 85, 86, 87 also comprises two substantially planar, orthogonally oriented, exterior surfaces or ends 95 that abut the inner surfaces of the base tray side panels 82 near the lower ends of the lower braces 84, 85, 86, 87.

Similarly, each of four upper braces 88, 89, 90, 91 is wedged between a corner post 76 and a vertical edge of the article 100 near the article's top end to help hold the packaged article 100 in place and protect the article 100 from outside abuse. Each of the four upper braces 88, 89, 90, 91 is configured to abut a portion of the article 100 and includes an inner wall 97 that abuts the article 100 near the top of the article and an outer wall 98 that abuts a corner post inner wall 77. Each of the four upper braces 88, 89, 90, 91 also comprises orthogonally oriented exterior surfaces or ends 99 substantially coplanar with the corresponding orthogonally oriented ends 95 of the lower braces 84, 85, 86, 87, and a substantially flat top surface 96 upon which an accessory tray 108 rests. The upper foam braces 88, 89, 90, 91 are shaped so that they mate with the top contours of the packaged article 100, thereby holding the article 100 stationary during storage, handling and transport. In other words, the top portion of the packaged article 100 is held stationary by the four upper braces 88, 89, 90, 91, which themselves are wedged between the article 100 and the corner posts 76.

In the assembled packaging system 10 the bottom of the packaged article 100 rests on the foam base insert 74 disposed inside the base tray 72.

The top cap 80 is conventional in design and comprises a top panel 104 having a perimeter and side panels 106 extending downward from the top panel perimeter.

An accessory tray 108 used to hold accessories may rest on the top surfaces 96 of the upper braces 88, 89, 90, 91 between the base tray 72 and the top cap 80. The accessory tray 108 has a rectangular central panel 110 having four corners and side panels 112 extending vertically upward from the central panel 110 to define a space within the accessory tray 108 for storing the accessories. The four corners 114 of the accessory tray 108 are beveled so as to define spaces exterior to the accessory tray for accommodating the four corner posts 76.

The packaging system 70 may be assembled in the following manner: First, the foam base insert 74 is placed inside the base tray 72, which may be resting on a conventional pallet 122. Next the printer or other article 100 to be packaged is placed onto the base tray 72 so that it rests on the foam base insert 74, leaving space at the four corners of the base tray 72 for the lower foam braces 84, 85, 86, 87 and the corner posts 76.

Next, the lower foam braces 84, 85, 86, 87 are positioned around the lower portion of the article 100 with their inner walls 93 abutting the article 100 and their exterior surfaces or ends 95 abutting the base tray side panels 82. The corner posts 76 are then inserted into the spaces between the lower foam braces 84, 85, 86, 87 and the four corners of the base tray 72 as shown in FIG. 4.

Next the upper foam braces 88, 89, 90, 91 are wedged between the corner posts 76 and the top portion of the printer 100. An accessory tray 108 may be placed onto the top surfaces of the four upper foam braces 88, 89, 90, 91 and an accessories box 124 and various other accessories 125 may be placed inside the accessories tray 108. A pair of substantially wedge-shaped ramps 126 may be placed within the accessories tray 108. The ramps 126 may be used to unload the article 100 after the packaged article has been delivered to its final destination.

Figure 6:
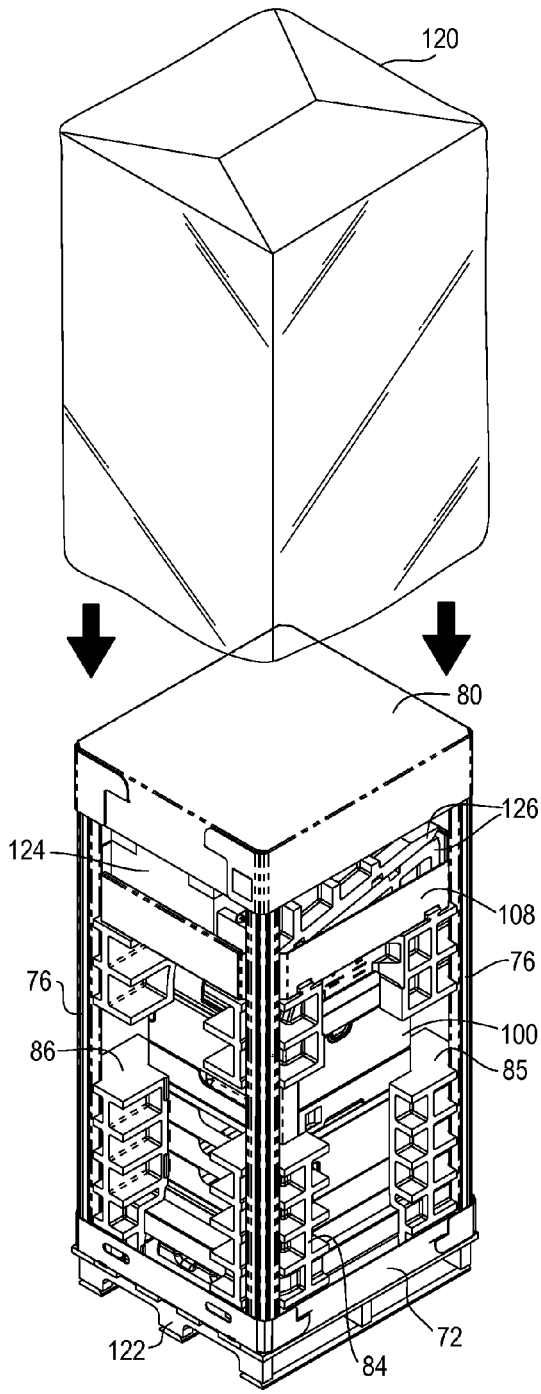
FIG. 6 is a perspective view of the packaging system of FIG. 3 shown prior to installation of the film wrap.
Figure 7:
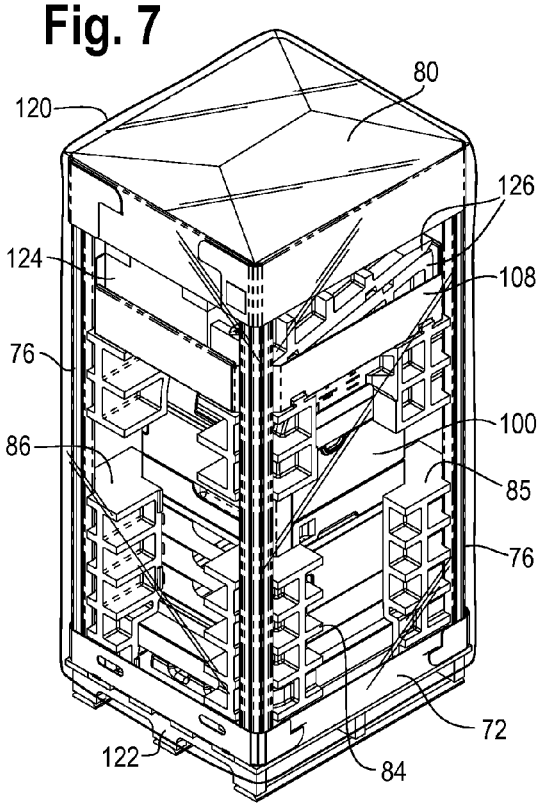
FIG. 7 is another perspective view of the packaging system of FIG. 3.
Figure 8:
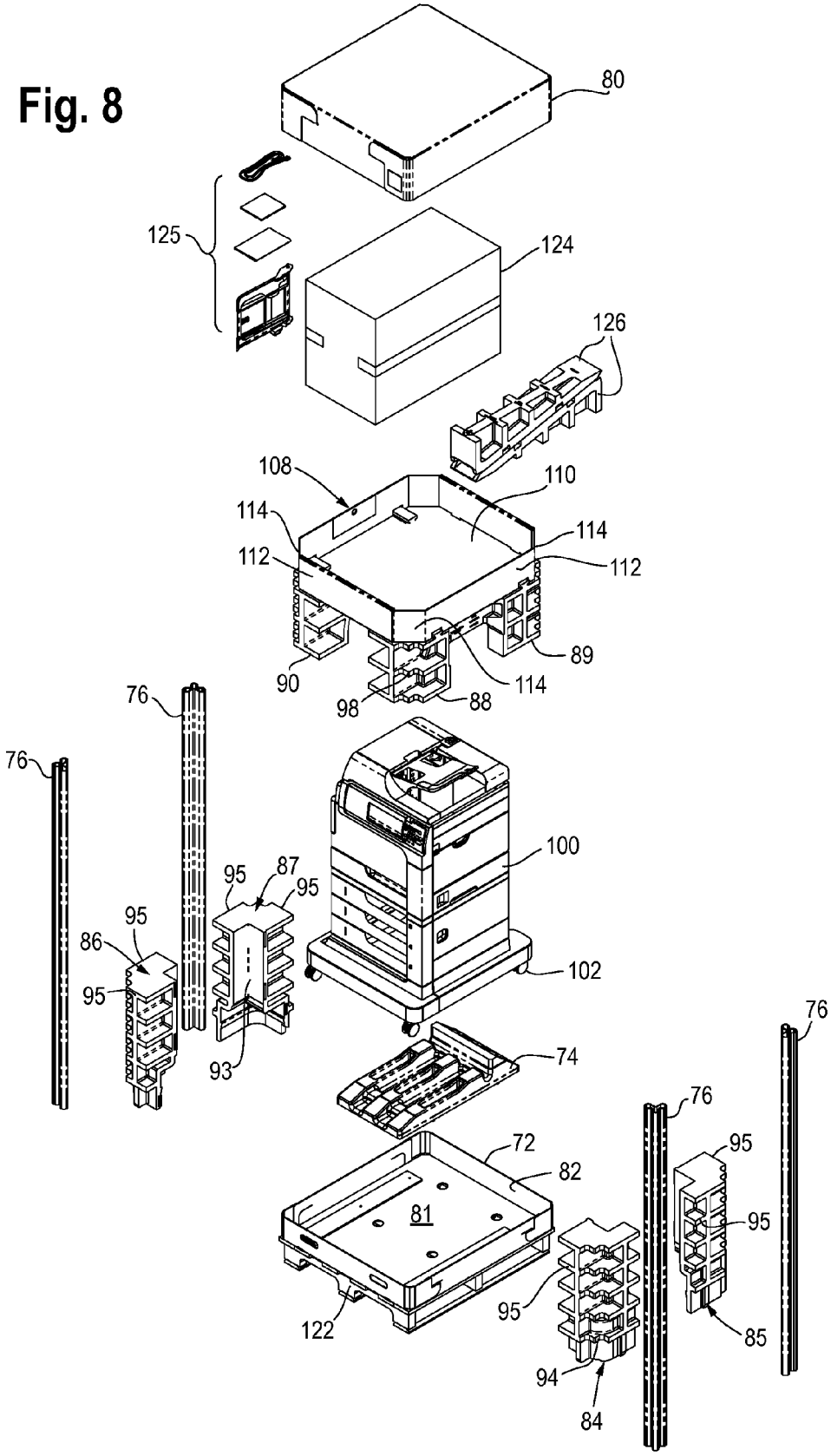
FIG. 8 is an exploded view of the packaging system of FIG. 3.

Optional cross braces (not shown) may be wedged inside the accessory tray 108. The top cap 80 is positioned onto the top ends of the corner posts 76. The assembled unit can then be wrapped in transparent outer wrap 120 as shown in FIGS. 6 and 7. Retainer straps (not shown) may be used to hold the unit 70 to the pallet 122. The pallet 122 can be formed of folded corrugated, wood, plastic or any suitable material.

Thus there has been described a packaging system for a printer/copier or similar article. Compared to conventional packages, the packaging system has been found to significantly reduce overall packaging weight and overall packaging volume. The system also reduces foam weight, foam volume, paper weight and paper volume. The packaging system can be made of 100% recyclable paper content. The system results in a higher shipping and storage density, resulting in substantial warehouse and freight savings.

It is understood that the embodiments of the invention described above are only particular examples which serve to illustrate the principles of the invention. Modifications and alternative embodiments of the invention are contemplated which do not depart from the scope of the invention as defined by the foregoing teachings and appended claims. It is intended that the claims cover all such modifications and alternative embodiments that fall within their scope.

We claim as our invention:

1. A packaging system for an article, the packaging system comprising:

a base tray comprising a substantially rectangular bottom panel having a perimeter and upwardly extending side panels affixed to the bottom panel perimeter, the bottom panel having four corners;

a plurality of foam base inserts disposed within the base tray, each foam base insert comprising a horizontal load bearing panel located adjacent the bottom panel and a vertical panel extending upwardly from the load bearing panel;

a top tray comprising a top panel having a perimeter and side panels extending downward from the top panel perimeter;

four vertically oriented corner posts, each corner post extending from a corner of the bottom panel to the top panel;

two elongated foam braces, each foam brace having opposing ends, each foam brace extending from one corner post to a second, orthogonally opposing corner post, each foam brace defining openings through which one of the corner posts extends; and an accessory tray having a rectangular central panel having four corners and side panels extending vertically upward from the central panel to define a space within the accessory tray for storing accessories, the central panel defining openings at each corner through which the corner posts extend, the accessory tray resting on the foam braces.

2. The packaging system of claim 1 further comprising two hinged ramps, each ramp comprising a first leg located adjacent the bottom panel and a second leg hingedly connected to the first leg.

3. A method of packaging an article, the article having a top, a bottom, four sides and wheels extending downward from the article bottom, the method comprising the steps of:

providing a flat base tray comprising a substantially rectangular bottom panel having a perimeter and side panels affixed to the bottom panel perimeter along fold lines, the bottom panel having four corners;

providing a pair of ramps, each ramp comprising a first leg and a second leg hingedly connected to the first leg;

placing the ramps within the base tray so that the first leg of each ramp is adjacent the base tray bottom panel and the second leg extends outward beyond the perimeter of the bottom panel;

placing the article onto the base tray so that its wheels rest on the first legs of the ramps;

placing foam base inserts within the base tray under the article so that the foam base inserts abut the sides of the article;

folding up the second legs of the ramps until they abut the sides of the printer;

folding up the base tray side panels against the foam base inserts;

securing a horizontal band around the base tray side panels;

inserting corner posts into the base tray so they extend vertically upward from each bottom panel corner, the corner posts having upper ends;

sliding two foam braces over the upper ends of respective pairs of adjacent corner posts until the foam braces fit against the top of the packaged article, each foam brace having a top surface;

sliding an accessory tray over the corner posts until the accessory tray rests on the top surfaces of the two foam braces; and positioning a top cap onto the top ends of the corner posts.

4. A packaging system for an article having a top, top contours, a bottom and four corners, the packaging system comprising:

a base tray comprising a substantially rectangular bottom panel having a perimeter and upwardly extending side panels affixed to the bottom panel perimeter, each side panel having an inner, product-facing surface, the bottom panel having four corners;

a top tray comprising a top panel having a perimeter and side panels extending downward from the top panel perimeter;

four vertically oriented corner posts, each corner post extending from a corner of the bottom panel to the top panel, each corner post comprising an inner wall and a substantially coextensive outer wall joined at opposing ends; and a plurality of lower braces, each lower brace having a lower end disposed within the base tray, each lower brace configured to be interposed between a corner post and a corner of the article, each lower brace having an inner wall configured to abut a corner of the article, an outer wall that abuts a corner post inner wall, and two substantially planar, orthogonally oriented, exterior surfaces that abut the inner surfaces of two orthogonally oriented base tray side panels.

5. The packaging system of claim 4 further comprising:

four upper braces, each upper brace interposed between a corner post and a corner of the article near the top of the article, each upper brace including an inner wall configured to abut the article and an outer wall that abuts a corner post inner wall, each upper brace also comprising substantially planar orthogonally oriented ends, the upper braces being configured so that they mate with the top contours of the packaged article.

6. The packaging system of claim 5 wherein each upper brace further comprises a substantially flat top surface upon which an accessory tray rests, wherein the accessory tray has a central panel having four corners and side panels extending vertically upward from the central panel to define a space within the accessory tray for storing accessories, the four corners of the accessory tray central panel being beveled so as to define spaces exterior to the accessory tray for accommodating the corner posts.

7. The packaging system of claim 6 wherein the accessories includes a pair of substantially wedge-shaped ramps.

* * * * *